US006871991B2

(12) United States Patent
Perrin

(10) Patent No.: US 6,871,991 B2
(45) Date of Patent: Mar. 29, 2005

(54) DIPPED HEADLIGHT OF SMALL SIZE FOR A MOTOR VEHICLE

(75) Inventor: Hervé Perrin, Bobigny Cedex (FR)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 10/113,209

(22) Filed: Mar. 28, 2002

(65) Prior Publication Data

US 2003/0002284 A1 Jan. 2, 2003

(30) Foreign Application Priority Data

Mar. 30, 2001 (FR) ..... 01 04542

(51) Int. Cl.[7] ..... F21V 7/00

(52) U.S. Cl. ..... 362/518; 362/297; 362/304; 362/346

(58) Field of Search ..... 362/518, 297, 362/304, 346

(56) References Cited

U.S. PATENT DOCUMENTS

| | | | | | |
|---|---|---|---|---|---|
| 4,305,119 | A | * | 12/1981 | Draper et al. | 362/309 |
| 4,351,018 | A | * | 9/1982 | Fratty | 362/215 |
| 4,704,661 | A | * | 11/1987 | Kosmatka | 362/61 |
| 4,803,601 | A | | 2/1989 | Collot et al. | 362/80 |
| 4,918,580 | A | * | 4/1990 | Nino | 362/61 |
| 4,972,307 | A | * | 11/1990 | Takatsuji et al. | 362/309 |
| 5,079,677 | A | * | 1/1992 | Kumagai | 362/61 |
| 5,086,376 | A | * | 2/1992 | Blusseau | 362/61 |
| 5,406,464 | A | * | 4/1995 | Saito | 362/61 |
| 6,024,473 | A | | 2/2000 | Fadel | 362/516 |
| 6,068,391 | A | | 5/2000 | Saladin et al. | 362/516 |

FOREIGN PATENT DOCUMENTS

| | | |
|---|---|---|
| EP | 0 854 316 A2 | 7/1998 |
| EP | 1 096 196 A1 | 5/2001 |
| FR | 2 760 067 | 8/1998 |
| FR | 2 760 068 | 8/1998 |
| FR | 2 760 070 | 8/1998 |

* cited by examiner

*Primary Examiner*—Thomas M. Sember
*Assistant Examiner*—Jacob Y Choi
(74) *Attorney, Agent, or Firm*—Morgan & Finnegan LLP

(57) ABSTRACT

The present invention relates to a dipped headlight for a motor vehicle, comprising a light source cooperating with a mirror in order to form an illuminating beam with a V-shaped cut-off, the mirror comprising four regions arranged side by side, a first region giving the beam its width, a second region giving the beam its range under the horizontal part of the cut-off, a third region giving the beam its range under the inclined part of the cut-off, and a fourth part giving the beam its range along the longitudinal axis of the vehicle.

According to the invention, each region is joined to the adjacent region without a step, the first region of the mirror has a reflecting surface which strongly spreads the light in the lateral direction, and the second and third regions are located on the same side of the light source.

12 Claims, 3 Drawing Sheets

-- Prior Art --

DIPPED HEADLIGHT OF SMALL SIZE FOR A MOTOR VEHICLE

TITLE OF THE INVENTION

Dipped headlight of small size for a motor vehicle

FIELD OF THE INVENTION

The present invention relates in general to headlights for motor vehicles, and in particular to dipped headlights.

BACKGROUND OF THE INVENTION

Dipped headlights for motor vehicles conventionally consist of a reflecting mirror sending light rays emitted by a light source towards the front of a vehicle and a glass possibly altering the path of these rays, in order to obtain a light beam having a predetermined photometry.

In a known manner, it is necessary to use a reflecting mirror of relatively large dimensions, particularly in width, in order to obtain a dipped headlight which complies both with the regulations in force and which is of high performance.

These large dimensions of the reflecting mirror are necessary in order, on the one hand, to recover a sufficient amount of the light flux emitted by the source and, on the other hand, to generate, in some regions of the mirror, images of the source which are small enough to form, in the dipped beam, a spot the concentration of which is intense enough to improve the range of the headlight.

Conventionally, the larger the mirror, for a given basic focal length, the larger the solid angle covered by the mirror seen by the source, and therefore the better the rate of recovery of the light flux coming from the source. However, the two objectives mentioned above are contradictory: the smaller the basic focal length of the mirror, that is to say the more the mirror is closed around the source, for a given height and width, the better the flux recovery, but the images of the source are all enlarged, and the range is insufficient. In contrast, if a longer basic focal length is used, the range is improved but the overall intensity of the beam is decreased in an undesirable manner.

This then results in the provision of mirrors comprising regions with different focal lengths, so as to improve both the range and the intensity of the beam, by combining the advantages of regions with short and with long focal lengths. The surface of mirrors designed in this way then has discontinuities and steps, which make the manufacture of such mirrors, their metallization and their final laquering difficult.

SUMMARY OF INVENTION

The present invention is set in this context and aims to overcome these drawbacks of the prior art, by providing a headlight which, while having an extremely small size as much in width as in height and in depth, is capable of generating a beam, especially a dipped beam, and more particularly a European dipped beam, having both a suitable range, a suitable width and good uniformity, the surface of the mirror not having steps.

The subject of the invention is therefore a dipped headlight for a motor vehicle, comprising a light source cooperating with a mirror in order to form an illuminating beam with a V-shaped cut-off, the mirror comprising at least three regions arranged side by side, a first region giving the beam its width, a second region giving the beam its range under the horizontal part of the cut-off, and a third region giving the beam its range under the inclined part of the cut-off.

According to the invention, each region is joined to the adjacent region without a step, the first region of the mirror has a reflecting surface which strongly spreads the light in the lateral direction, and the second and third regions are located on the same side of the light source.

According to other characteristics of the invention:

- the second region, giving the beam its range under the horizontal part of the cut-off, is closer to the light source than the third region, giving the beam its range under the inclined part of the cut-off.
- the mirror furthermore comprises a fourth region giving the beam its range along the longitudinal axis of the vehicle.
- the fourth region is located adjacent to the third region, while at the same time being further away from the light source than this third region.
- the third and fourth regions are joined without a step.
- at least some regions of the mirror which spread the light produce a slightly divergent spread.

Others aims, characteristics and advantages of the present invention will become better apparent on reading the following description of a preferred embodiment thereof, given by way of non-limiting example and made with reference to the appended drawings.

DETAILED DESCRIPTION OF THE INVENTION

Figure 1:
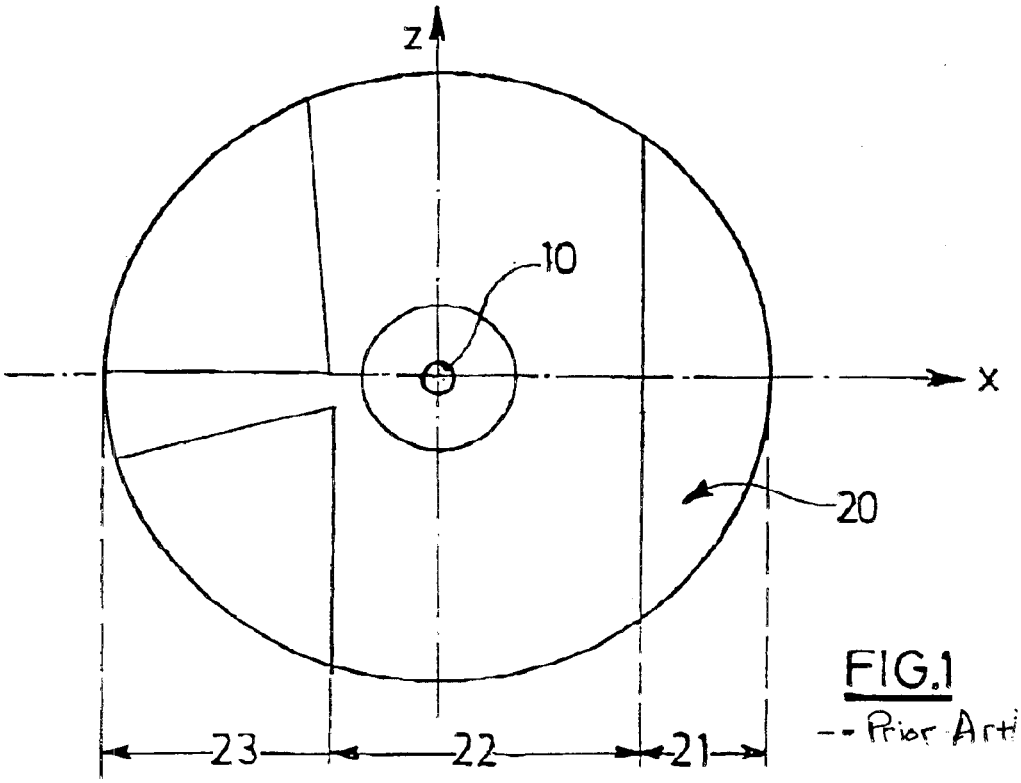
FIG. 1 is a schematic back view of a mirror for a European dipped headlight for the left side of a vehicle, according to a known design.

FIG. 1 shows a mirror 20 of the prior art, intended to cooperate with a light source 10, such as a filament, oriented axially, of an incandescent lamp such as a standardized "H1" or "H7" lamp, or else such as the electric arc of a discharge lamp.

By convention, an orthonormal coordinate system Oxyz centred on the light source 10 is defined, the axis Oy being horizontal and parallel to the longitudinal axis of the vehicle, the axis Ox being horizontal and perpendicular to the axis Oz, and the axis Oz being vertical and perpendicular to the first two axes.

The mirror 20 is intended to generate by itself a dipped beam, without there being any need to use another optical component, such as, for example, striations or prisms formed on a closure glass placed in front of the mirror 20. This glass may then be plain or slightly deflecting.

The mirror 20 is subdivided into three regions 21, 22, 23, separated by substantially vertical planes parallel to the median plane yOz passing through the source 10, these three regions having spreads and geometries which are different one from the other.

The central region 22 is intended to provide considerable spreading of the light, in order to give the light beam its width. It may, for example, be of the type described in Patents FR-B-2 760 067 and FR-B-2 760 068 in the name of the Applicant.

The region 21 located to the right in FIG. 1 is intended mainly to give to the beam to be generated (in this case a standard European dipped beam, with a "V"-shaped cut-off) its range, that is to say, a substantial portion of the region 21 is intended to generate light along the axis of the road or in the vicinity of this axis, below the horizontal cut-off.

The region 23 located to the left in FIG. 1 is capable of generating, by means of its upper part, a beam part with a horizontal cut-off, and has rows of slightly deflecting vertical striations or prisms, while the lower part of the region 23 is capable, by simply tilting the surface by, for example, 15°, of generating a beam part inclined at 15°, in order to define the inclined half cut-off of the European dipped beam, and has rows of slightly deflecting striations or prisms inclined at 15° with respect to the vertical.

A mirror design of this sort, although completely satisfactory, is difficult to apply when it is necessary to produce mirrors of small dimensions, which then entails that the region 21 has only a small lateral spread in the direction Ox. The problem, in this case, is that the horizontal cut-off can no longer be clean. The result of this is, on the one hand, a sharp deterioration of the photometric performance of the beam, which can no longer comply with the regulations, and, on the other hand, greater difficulty in adjusting the beam in terms of elevation, since the adjustment systems are based on detecting the position of the horizontal cut-off.

The present invention provides a solution to this problem of obtaining a European dipped beam, having both a suitable range, a suitable width and good uniformity with a small-sized headlight, of which the mirror itself has small dimensions.

Figure 2:
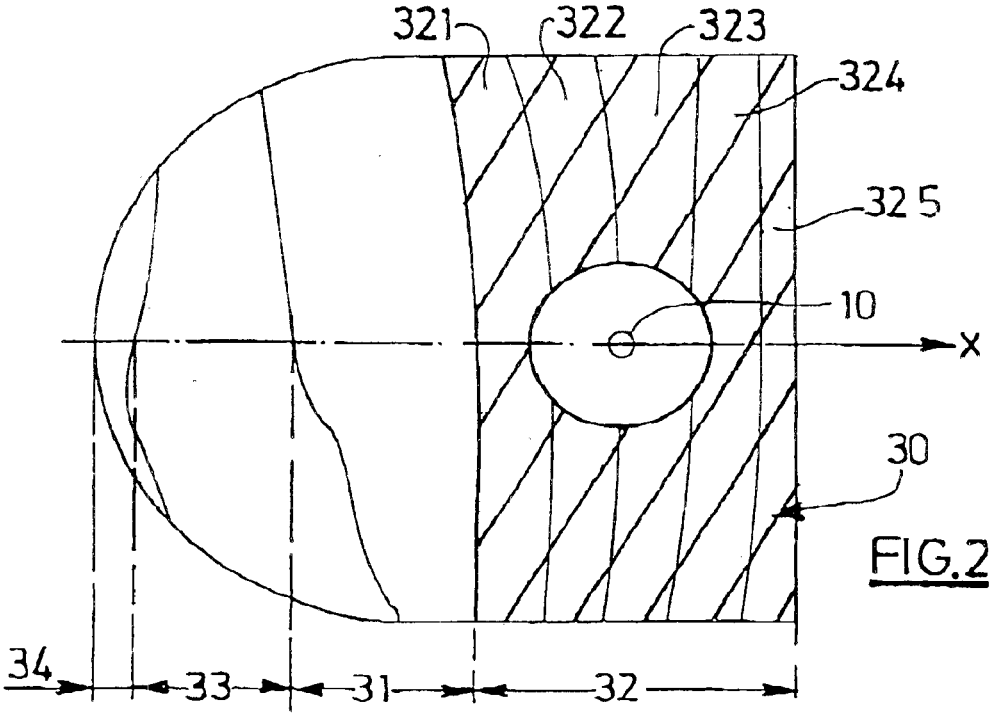
FIG. 2 is a schematic back view of a mirror for a European dipped headlight for the left side of a vehicle, according to the present invention.

FIG. 2 shows a mirror 30, intended to cooperate with an axial light source 10, such as the filament of a standardized "H1" or "H7" incandescent lamp, or else the electric arc of a discharge lamp.

The mirror 30 is subdivided into four regions 31, 32, 33 and 34, identified as such by their intersection with the horizontal plane xOy. These three regions have spreads and geometries which are different one from the other.

The region 32, similar to the region 22 of the headlight of FIG. 1, is capable of generating considerable spreads of the light, thus giving the light beam its width. It comprises a series of regions 321, 322, 323, 324 and 325, whose parameters, especially in terms of horizontal generatrix, may be set in a way similar to that carried out for a mirror of the usual dimensions. In the present example, the region 32 has regions constituting striations capable of giving the reflected light a predetermined degree of spread, with lateral limits $\mathbf{32}_G$ and $\mathbf{32}_D$ (FIG. 4) which are preferably blurred in order to prevent beam uniformity defects, and capable of completely locating this light below the standardized horizontal cut-off. In order to produce these striations, the teachings of the aforementioned documents FR-A-2 760 067 or FR-A-2 760 068 in the name of the Applicant can advantageously be used.

Figure 3:
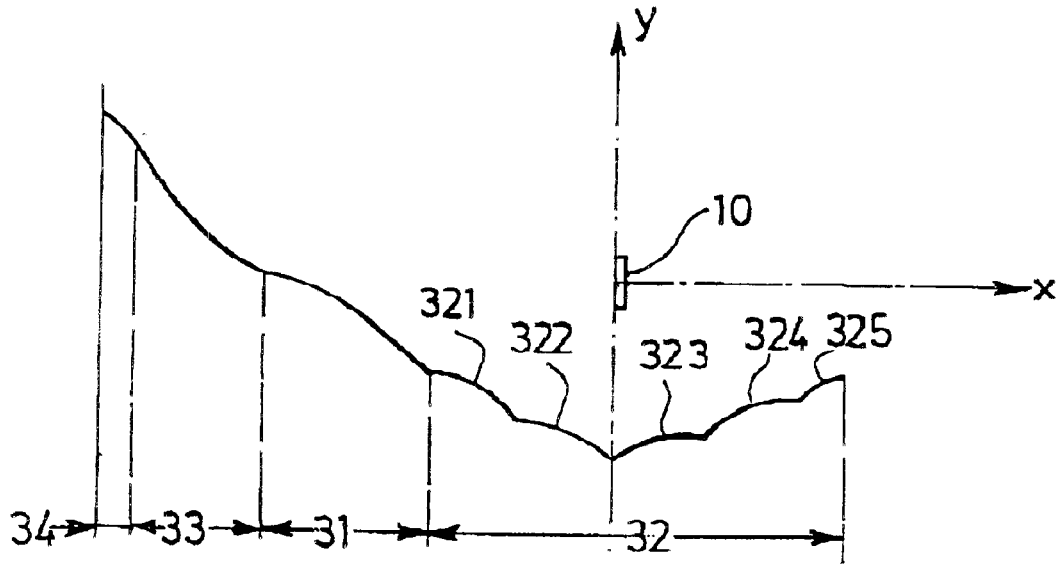
FIG. 3 is a schematic view in axial horizontal section of the mirror of FIG. 2, and of the source with which it cooperates.
Figure 4:
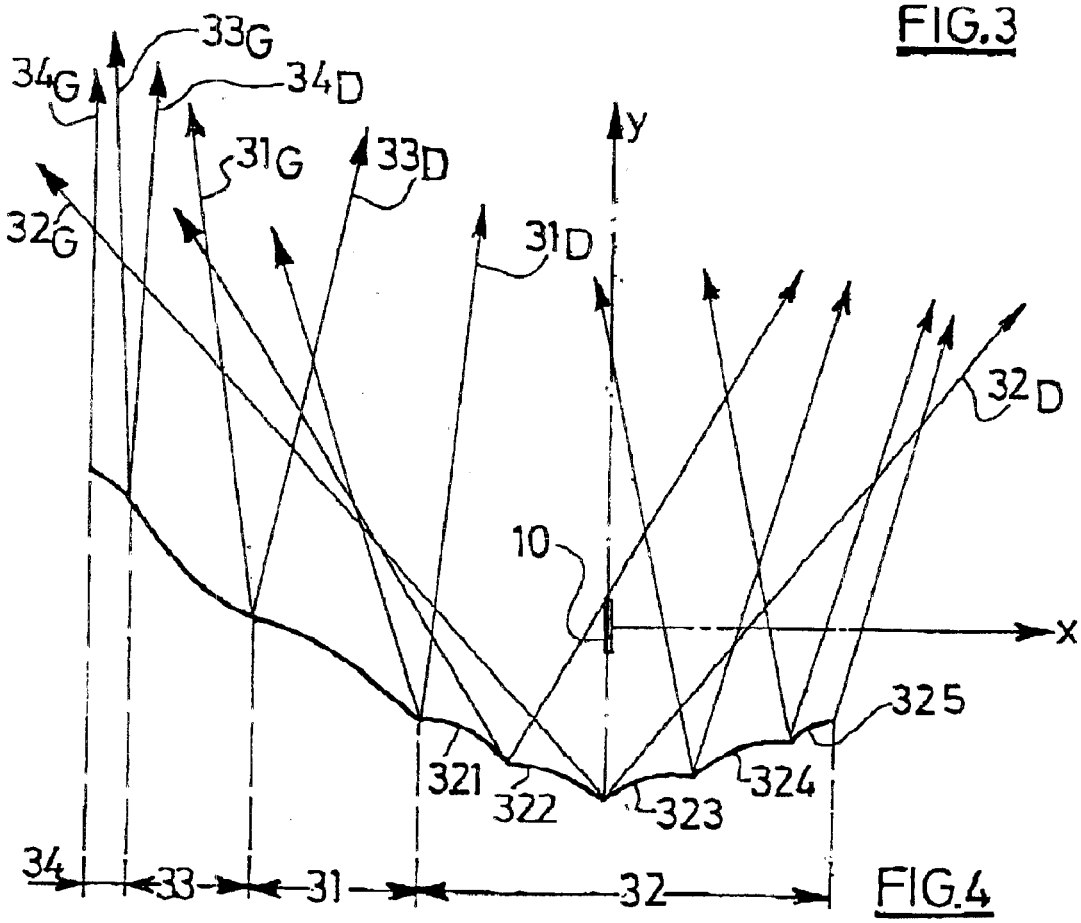
FIG. 4 is a view similar to FIG. 3, illustrating the paths of some light rays reflected by the various regions of the mirror.
Figure 5A:
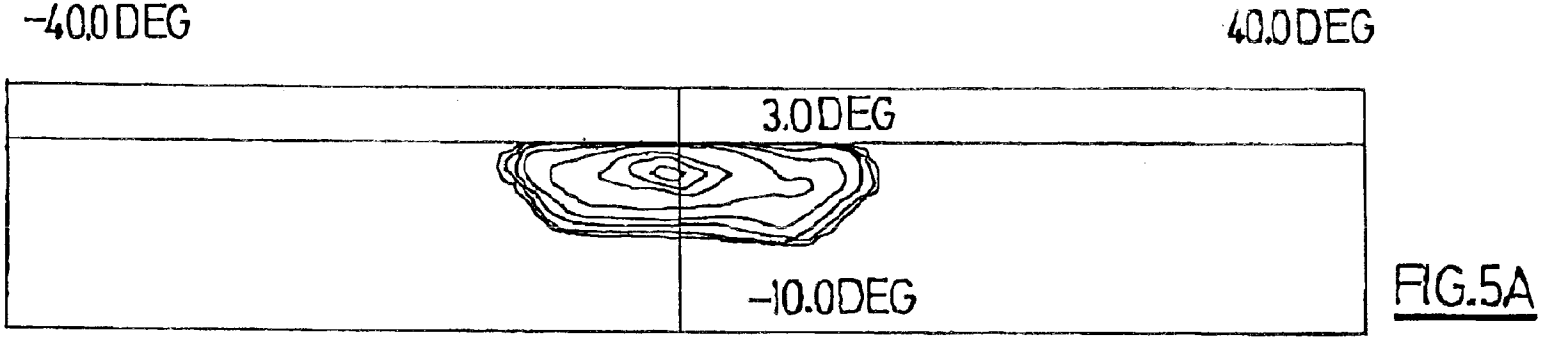
FIGS. 5A to 5C illustrate, by sets of isolux curves on a projection screen, the appearance of various parts of a beam generated by the source/mirror assembly of FIGS. 2 to 4.

The region 31, located to the left of the region 32 in FIGS. 2 to 4, is capable of generating the part of the beam with a horizontal cut-off, in order to give it its range under this horizontal cut-off. The region 31 is thus shaped so as to reflect the light rays emitted by the source 10 only in slightly divergent directions, for example between the rays $\mathbf{31}_G$ and $\mathbf{31}_D$ in FIG. 4. This region 31, taken alone, thus gives a contribution to the beam, which contribution is shown by the isolux curves of FIG. 5A.

Figure 5B:
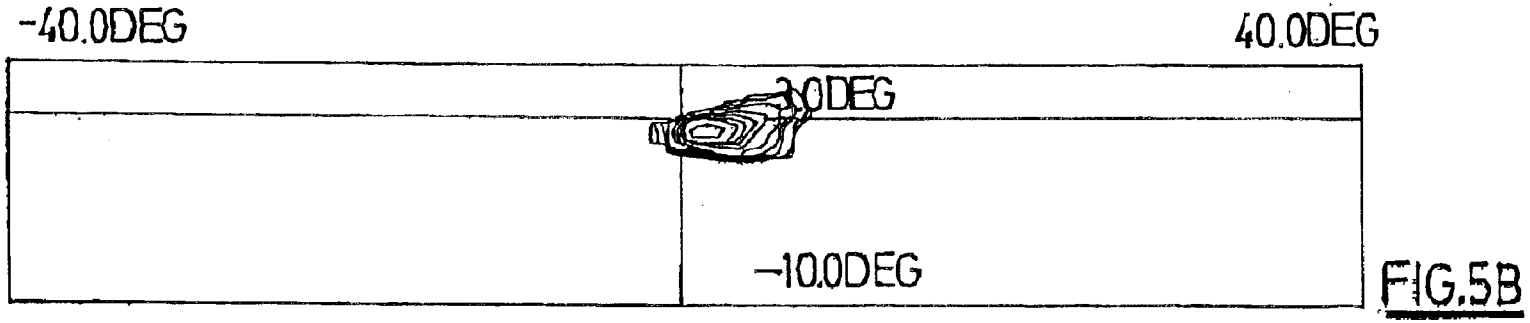

The region 33, located to the left of the region 31 in FIGS. 2 to 4, is capable of generating the part of the beam located under the 15° cut-off of the dipped beam. It is constructed from a parabolic basic surface, while automatically generating the cut-off of the beam according, for example, to the teachings of document FR-A-2 536 502, in the name of the Applicant, it being possible for striations and/or prisms, according to the teachings of document FR-A-2 710 393, also in the name of the Applicant, to be applied to this basic surface, there being inclined at 15° to the horizontal. The region 33 is therefore shaped so as to reflect light rays emitted by the source 10 only in slightly divergent directions, for example between the rays $\mathbf{33}_G$ and $\mathbf{33}_D$ in FIG. 4. The region 33 thus contributes to forming the beam part shown by the isolux curves in FIG. 5B.

Figure 5C:
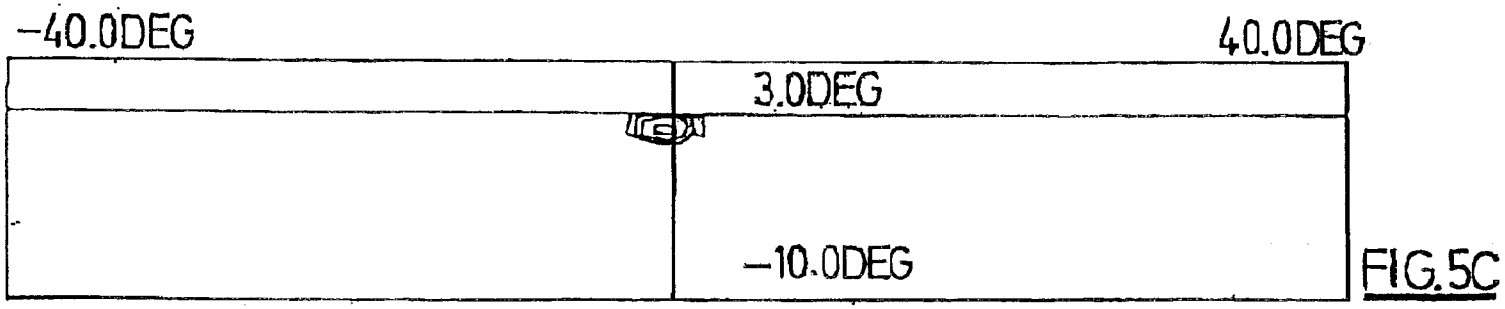

The region 34, located to the left of the region 33 in FIGS. 2 to 4, is capable of generating the light rays giving the beam its range along the longitudinal axis of the vehicle, and it is shaped so as to reflect the light rays emitted by the source 10 only in slightly divergent directions, for example between the rays $\mathbf{34}_G$ and $\mathbf{34}_D$ in FIG. 4, and contributing to forming the beam part shown by the isolux curves in FIG. 5C. It is understood that a surface of this sort, in its part furthest away from the source 10, will thus generate images of this source which are small enough to give the beam a satisfactory range. Furthermore, the beam generated by the region 34, being superimposed on those which are generated by the regions 31 and 33, contributes to making the connection between these two beams and to giving the beam greater uniformity.

Because the regions 31, 33 and 34 of the mirror are substantially more closed around the source than its region 32, provision is made for the mirror to be strongly asymmetric in terms of spread on either side of the lamp, as is shown clearly in FIGS. 2 to 4.

This therefore makes it possible to produce a mirror of small width, which generates a beam which is quite satisfactory in terms of range, width, overall flux and uniformity. The height of the mirror is advantageously close to its width. A mirror whose width and height are very small, and which has no step, is thus produced.

This has the advantage that the mirror emits no unwanted radiation which could be generated by such steps.

It is understood from the above description that, when the extinguished lamp/mirror unit is observed from the outside, through a glass which will typically be plain, the observer notices that the lamp is strongly offset laterally with respect to the middle of the mirror.

In order to retain a symmetry in appearance of the vehicle, it is therefore advantageous to design the lamp/mirror assembly intended to be used in the right headlight in such a way that the lateral offset of the lamp in the mirror is reversed with respect to the offset in the left headlight.

Of course, the present invention is in no way limited to the embodiments described and shown, and a person skilled in the art will know how to provide many variants or modifications thereof.

What is claimed is:

1. A dipped headlight for a motor vehicle, comprising a light source cooperating with a mirror in order to form an illuminating beam with a V-shaped cut-off, the mirror comprising at least three regions arranged side by side, a first region giving the beam its width, a second region giving the beam its range under the horizontal part of the cut-off, a third region giving the beam its range under the inclined part of the cut-off, wherein each region is joined to the adjacent region without a step, in that the first region of the mirror has a reflecting surface which strongly spreads the light in the lateral direction, and in that the second and third regions are located on the same lateral side of the first region.

2. A headlight according to claim 1, wherein the second region, giving the beam its range under the horizontal part of the cut-off, is closer to the light source than the third region, giving the beam its range under the inclined part of the cut-off.

3. A headlight according to claim 1, which comprises a fourth region giving the beam its range along the longitudinal axis of the vehicle.

4. A headlight according to claim 3, wherein the fourth region is adjacent to the third region, and further away from the light source than the third region.

5. A headlight according to claim 3, wherein the third and fourth regions are joined without a step.

6. A headlight according to claim 1, wherein at least some regions of the mirror which spread the light produce a slightly divergent spread.

7. A headlight according to claim 2, comprising a fourth region giving the beam its range along the longitudinal axis of the vehicle.

8. A headlight according to claim 4, wherein the third and fourth regions are joined without a step.

9. A headlight according to claim 2, wherein at least some regions of the mirror which spread the light produce a slightly divergent spread.

10. A headlight according to claim 3, wherein at least some regions of the mirror which spread the light produce a slightly divergent spread.

11. A headlight according to claim 4, wherein at least some regions of the mirror which spread the light produce a slightly divergent spread.

12. A headlight according to claim 5, wherein at least some regions of the mirror which spread the light produce a slightly divergent spread.

* * * * *